US005842509A

United States Patent [19]

Nagashima et al.

[11] Patent Number: 5,842,509

[45] Date of Patent: Dec. 1, 1998

[54] APPLICATION METHOD OF POWDER MOLD LUBRICANT TO VACUUM DIE-CASTING MOLD AND VACUUM DIE-CASTING APPARATUS

[75] Inventors: Katsuo Nagashima, Shibata-gun; Shinichi Oomachi, Natori; Fumihiro Sakuma, Shiroishi, all of Japan

[73] Assignee: Keihin Corporation, Tokyo, Japan

[21] Appl. No.: 837,045

[22] Filed: Apr. 11, 1997

[30] Foreign Application Priority Data

Apr. 12, 1996 [JP] Japan ..... 8-115561

[51] Int. Cl.[6] ..... B22D 17/20

[52] U.S. Cl. ..... 164/63; 164/65; 164/72; 164/113; 164/254; 164/267; 164/312

[58] Field of Search ..... 164/72, 149, 267, 164/61, 63, 65, 113, 312, 313, 314, 253, 254

[56] References Cited

U.S. PATENT DOCUMENTS

| | | | |
|---|---|---|---|
| 4,562,875 | 1/1986 | Ogoshi et al. | 164/72 |
| 4,955,424 | 9/1990 | Takehisa et al. | 164/72 |

FOREIGN PATENT DOCUMENTS

| | | | |
|---|---|---|---|
| 1191522 | 4/1965 | Germany | 164/254 |
| 2-151358 | 6/1990 | Japan | 164/313 |
| 3-128159 | 5/1991 | Japan | 164/72 |
| 3-151154 | 6/1991 | Japan | 164/254 |
| 3-151155 | 6/1991 | Japan | 164/254 |
| 4-178254 | 6/1992 | Japan | 164/254 |
| 6-179046 | 6/1994 | Japan | 164/267 |

*Primary Examiner*—J. Reed Batten, Jr.
*Attorney, Agent, or Firm*—Pillsbury Madison & Sutro LLP

[57] ABSTRACT

An application method of a powder mold lubricant for a vacuum die-casting mold can effectively apply the powder mold lubricant onto a mold surface of the mold cavity with supplying the powder mold lubricant in small amount, can avoid liquefying of the power mold lubricant to degrade quality of a product, and can avoid loss in cycle time in a vacuum die-casting operation. The method for applying a powder mold lubricant in a vacuum die-casting apparatus includes steps of clamping a movable mother die and a stationary mother die, and defining a mold cavity by a movable insert die and a stationary insert die, in which a plunger tip is movably disposed within a sleeve opens a molten material supply hole and blocks communication between the sleeve and the mold cavity, an application step of applying a powder mold lubricant to a mold surface of the mold cavity by directly supplying a powder mold lubricant in a powder storage tank directly to a mold cavity through a powder discharge passage and a molten material supply passage, a vacuum pressure introducing step blocking a powder suction passage opening to the mold cavity and communicating a vacuum source and a molten material supply passage opening in the mold cavity, for maintaining the interior of the mold cavity in vacuum condition, the vacuum pressure introducing step being performed following the powder mold lubricant application step.

7 Claims, 4 Drawing Sheets

2
3
1
7
22
4
24
4A
C
1A
11
10A
G
G1
8
8A
9
14A
14
V
10
15
16
13
12
17
G
G2
18A
18
23
5
6
Q
T
20
19
21
P

APPLICATION METHOD OF POWDER MOLD LUBRICANT TO VACUUM DIE-CASTING MOLD AND VACUUM DIE-CASTING APPARATUS

BACKGROUND OF THE INVENTION

1. Field of the Invention

The present invention relates to an application method of a powder mold lubricant for applying a powder mold lubricant on a molding surface of a cavity formed by a movable insert die and a stationary insert die in a vacuum die-casting apparatus, and to a vacuum die-casting apparatus suitable for implementing the application method.

2. Description of the Related Art

Conventional application method of powder mold lubricant has been disclosed in Japanese Examined Patent Publication (Kokoku) No. Heisei 7-63830. In the disclosed method, a mold of a die-casting apparatus is clamped to form a cavity. Then, interior of the cavity is evacuated through an evacuation port communicated to one side of the cavity for reducing the internal pressure in the cavity to suck the mold lubricant into the cavity through a supply passage communicated to the other side of the cavity for applying a powder mold lubricant on the surface of the cavity. Supply of the powder mold lubricant to the supply passage is performed through a sleeve, in which a plunger tip is slidably disposed.

In the conventional application method of the powder mold lubricant, the following problems are encountered.

(1) A difficulty should be encountered in application for a vacuum die-casting apparatus which is designed to hold interior of a mold cavity in vacuum condition and injecting a molten material into the mold cavity.

(2) The powder mold lubricant flows into the cavity via the supply line after flowing into the sleeve from a mold lubricant blowing opening formed within the sleeve. In this manner, among the passage for supplying the powder mold lubricant, a chamber volume in the sleeve is increased for slidably receiving the plunger tip to enlarge the volume. Since the powder mold lubricant is fine particle mixture solid of wax, talc, graphite and the like and has mass weight, they tends to fall down and is accumulated in the bottom. From this, it is difficult to effectively supply the powder mold lubricant supplied from the mold lubricant blowing opening into the cavity. Therefore, quite large amount of powder mold lubricant has to be supplied accruing falling down and accumulation to cause large economical loss.

(3) The powder mold lubricant is fine particle mixed solid of wax, talc, graphite and the like, and among these components, organic powder is liquefied at about 120° C. On the other hand, melt of aluminum, zinc alloy and the like flows through the sleeve. Therefore, during casting, the temperature of the sleeve can be elevated to about 200° C. In the above, among the powder mold lubricant supplied into the sleeve from the mold lubricant blowing opening, the organic type powder is liquefied in the sleeve to be accumulated in the bottom of the sleeve. The liquefied powder mold lubricant accumulated in the sleeve is injected in the cavity in admixed form with the melt supplied into the sleeve via a supply opening. This is not desirable for degradation of quality of product. Furthermore, the liquefied powder mold lubricant is heated on the mold surface of the cavity to cause large amount of lamp black upon mold opening to cause degradation of working environment.

(4) Upon reducing pressure in the cavity by evacuation through the evacuation port, the supply opening has to be closed to make the cavity into an enclosed chamber. Accordingly, upon pressure reduction through the evacuation port, it becomes necessary to keep the supply opening which is opened in the cylinder, closed by moving the plunger tip in the cylinder forward and stopped in place. After application of the powder mold lubricant on the mold surface of the cavity by supplying powder mold lubricant into the cavity in the vacuum condition through the mold lubricant blowing opening for preparation for injection of melt into the cavity.

As set forth above, upon application of the powder mold lubricant, it is inherent to drive the plunger tip for forward motion, stopping and backward motion. Therefore, loss should be caused in the cycle time of the die casting operation to cause difficulty in improving production efficiency.

SUMMARY OF THE INVENTION

The present invention has been worked out in view of the problems set forth above. Therefore, it is an object of the present invention to provide an application method of a powder mold lubricant for a vacuum die-casting mold which can effectively apply the powder mold lubricant onto a mold surface of the mold cavity with supplying the powder mold lubricant in small amount, can avoid liquefying of the power mold lubricant to degrade quality of a product, and can avoid loss in cycle time in a vacuum die-casting operation.

Another object of the present invention is to provide a vacuum die-casting apparatus suitable for implementing the powder state mold lubricant application method according to the present invention.

A method for applying a powder mold lubricant in a vacuum die-casting apparatus, according to the first aspect of the present invention, comprises:

clamping a movable mother die and a stationary mother die, and defining a mold cavity by a movable insert die and a stationary insert die, in which a plunger tip is movably disposed within a sleeve opens a molten material supply hole and blocks communication between the sleeve and the mold cavity;

an application step of applying a powder mold lubricant to a mold surface of the mold cavity by directly supplying a powder mold lubricant in a powder storage tank directly to a mold cavity through a powder discharge passage and a molten material supply passage;

a vacuum pressure introducing step blocking a powder suction passage opening to the mold cavity and communicating a vacuum source and a molten material supply passage opening in the mold cavity, for maintaining the interior of the mold cavity in vacuum condition, the vacuum pressure introducing step being performed following the powder mold lubricant application step.

With the construction set forth above, the mold cavity is reduced the pressure by a powder suction passage. Toward the mold cavity under the vacuum condition, the powder mold lubricant in the powder storage tank is directly supplied to apply the powder mold lubricant on the mold surface of the mold cavity.

On the other hand, in the vacuum introducing step, the vacuum introducing step, the vacuum suction passage establishes communication between the vacuum source and the mold cavity. The vacuum pressure generated by the vacuum source is introduced into the mold cavity via the passage to maintain the mold cavity in vacuum condition.

Then, the molten material in the sleeve is injected into the mold cavity under vacuum condition.

At any one of the powder mold lubricant application step in the clamping condition or the vacuum pressure introducing step, a molten material may be supplied into the sleeve from the molten material supply hole.

In the clamped condition, in the application step of the powder mold lubricant or in the vacuum introducing step, the molten material is supplied into the sleeve by the molten material supply opening to get ready for injection step.

The powder discharge passage may be cooled at a temperature lower than or equal to a liquefying temperature of the powder mold lubricant.

The powder mold lubricant supplied into the mold cavity is cooled to be lower than or equal to a liquefying temperature of the powder mold lubricant. Therefore, the powder mold lubricant can be maintained in the floating condition. By this, the powder mold lubricant will never be liquefied to be effectively applied on the mold surface within the mold cavity.

A vacuum die-casting apparatus, according to the second aspect of the invention, comprises:

a powder control valve guide hole opening to a sleeve, in which a plunger tip is movably disposed, and opening and switching passage communicated with a molten material supply passage being formed on the outer periphery thereof;

a powder control valve disposed within the powder control valve guide hole and being operated by a driving device in such a manner that, in a condition where communication between the opening and the sleeve is blocked, communication between the opening and the switching passage is established, and in a condition where communication between the opening and the sleeve is established, communication between the opening and the switching passage is blocked;

a powder suction passage communicated with a pressure reducing device at one end and opening to the mold cavity at the other end for controlling to open and close by a switching valve; and a switching valve for selectively communicating one of a vacuum pressure introducing passage connected to a vacuum pressure source and a powder discharge passage connected to a powder storage tank, to a switching passage.

By the powder control valve movably disposed within the powder control valve guide hole, the powder control valve guide hole is opened. The sleeve is controlled to establish and block communication with the switching passage. By the switching valve, the powder suction passage is controlled to establish and block communication with the mold cavity. Any one of the vacuum introducing passage or the powder discharge passage and the switching passage is communicated by the switching valve. Thus, it is suitable for application of the powder mold lubricant and vacuum introduction. Thus, vacuum die-casting apparatus with no cycle time loss can be provided.

A vacuum die-casting apparatus, according to the third aspect of the invention, comprises:

a powder control valve guide hole opening to a sleeve, in which a plunger tip is movably disposed, and opening and switching passage communicated with a molten material supply passage being formed on the outer periphery thereof;

a powder control valve disposed within the powder control valve guide hole, defining a chamber therein, an opening of the switching passage arranged in the chamber being opened on the outer periphery of a sliding cylindrical portion, and being operated by a driving device in such a manner that, in a condition where communication between the opening and the sleeve is blocked, communication between the opening and the switching passage is established, and in a condition where communication between the opening and the sleeve is established, communication between the opening and the switching passage is blocked;

a powder suction passage communicated with a pressure reducing device at one end and opening to the mold cavity at the other end for controlling to open and close by a switching valve; and a switching valve for selectively communicating one of a vacuum pressure introducing passage connected to a vacuum pressure source and a powder discharge passage connected to a powder storage tank, to a switching passage.

Particularly, the switching passage is arranged within a chamber formed in the powder control valve, and the opening of the switching passage is opened to the outer periphery of the sliding cylindrical portion of the powder control valve. Thus, the passage performing vacuum introduction and passage to open and close for discharging the powder can be provided.

The chamber recessed in the powder control valve may be enclosed, a cooling liquid being circulated within the chamber through a cooling water introducing passage and a cooling water discharging passage for cooling the switching passage at a temperature lower than or equal to a liquefying temperature of the powder mold lubricant.

The switching passage communicated with the powder discharge passage passing the powder mold lubricant is arranged within a chamber of the powder control valve, in which the cooling liquid is introduced. Therefore, the powder mold lubricant can be effectively cooled at a temperature lower than or equal to a liquefying temperature of the powder mold lubricant. Thus, the powder mold lubricant can be efficiently cooled with simple structure.

A powder control valve guide hole may be formed mating with the sleeve in coaxial fashion, the powder control valve movably disposed in the powder control valve guide hole is arranged in opposition to a plunger tip movably disposed within the sleeve.

Since the powder control valve guide hole and the powder control valve are arranged in a space which is not used in the conventional die-casting apparatus, layout thereof becomes easy. Furthermore, application of the present invention to the conventional die-casting apparatus is facilitated.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to be present invention, but are for explanation and understanding only.

In the drawings.

DESCRIPTION OF THE PREFERRED EMBODIMENT

Figure 1:
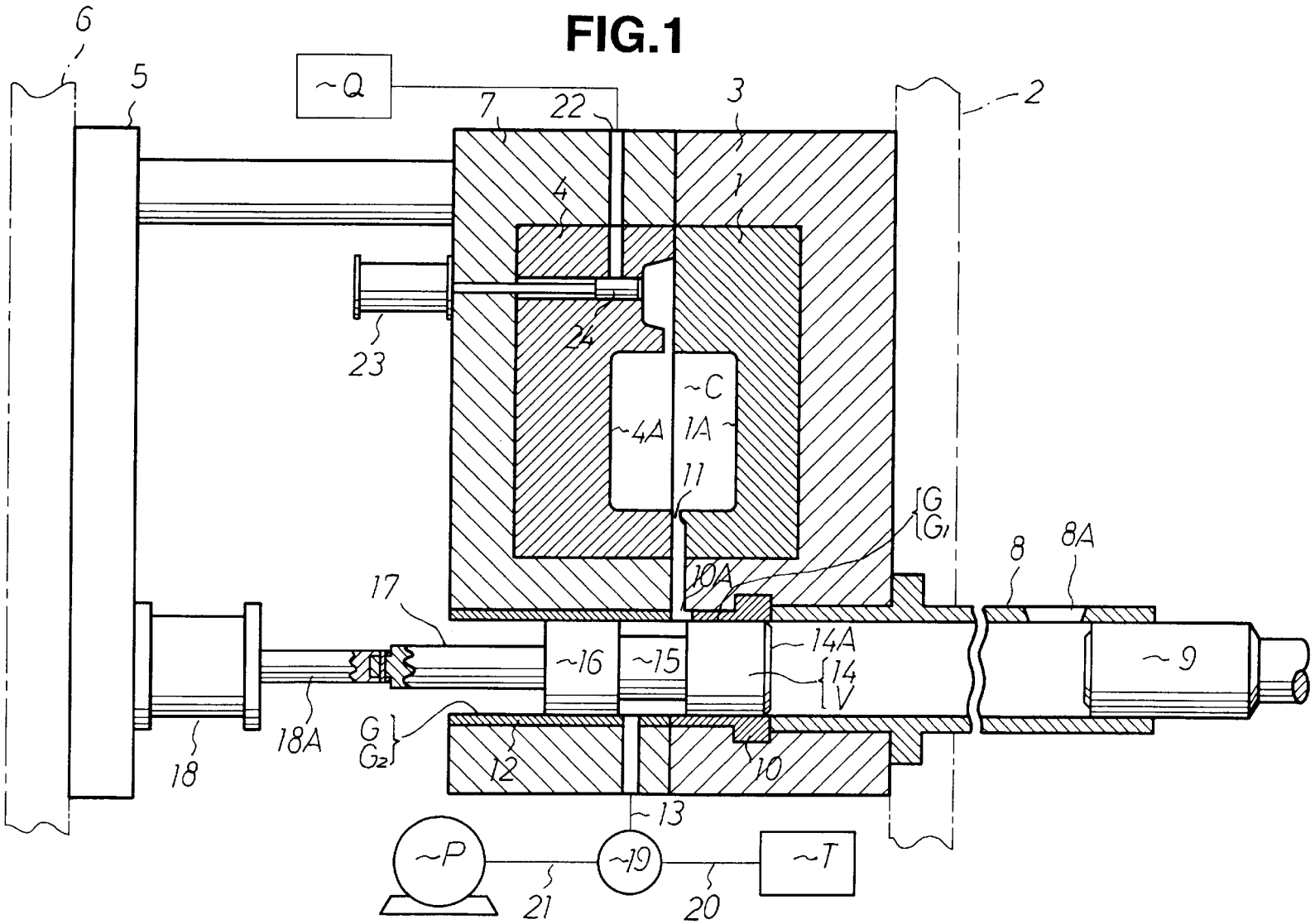
FIG. 1 is a section of the major part of the first embodiment of a die-casting apparatus according to the present invention, which is illustrated in a condition where communication between a sleeve and an opening is blocked by a powder control valve.

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

At first, the first embodiment of powder mold lubricant application method in a vacuum die-casting apparatus, and a vacuum die-casting apparatus according to the present invention will be discussed with reference to FIGS. 1 and 2.

The reference numeral 1 denotes a stationary insert die which is formed with a concave mold surface 1A corresponding to a product surface at one side. The stationary insert die is fixed with a cavity of the stationary mother die 3 which is, in turn, fixed on a stationary base 2 of a casting machine.

The reference numeral 4 denotes a movable insert die having a concave mold surface 4A corresponding to the surface of the product at the other side. The movable insert die 4 is arranged and fixed to a cavity in the movable mother die 7 which is, in turn, fixed to a movable base 6 via a die base 5. By fitting the mating surfaces of the stationary insert die 1 and the movable insert die 4, a molding cavity C defining a space corresponding to the shape of the product with the mold surface 1A of the stationary insert die 1 and the mold surface 4A of the movable insert die 4.

The reference numeral 8 denotes a cylindrical sleeve fixed to the stationary mother die 3 via the stationary base 2. A plunger tip 9 is movably disposed with the sleeve 8. In the drawings, a molten material supply hole 8A is formed in the vicinity of the right side end of the sleeve in communication with the interior of the sleeve 8.

The reference numeral 10 denotes a spool bushing. The right side end of the spool bushing is in contact with the left side end of the sleeve 8.

The left side end of the spool bushing 10 is located on the left side end surface of the stationary mother die 3. A powder control valve guide hole G1 extends from the left side end to the right side end of the spool bushing 10. The right side end of the powder control valve guide hole G1 is mated in communication with the sleeve 8.

Also, in the vicinity of the left side end of the spool bushing 10, an opening 10A opening to the powder control valve guide hole G1 is formed. The opening 10A is communicated with the molten material supply passage 11 which is, in turn, communicated with the mold cavity C.

On the movable mother die 7, a guide bushing 12 is fixedly arranged to extend from the right side end to the left side end. In the guide bushing 10, a powder control valve guide G2 having the same diameter to and coaxially with the powder control valve guide G1. In the powder control valve guide hole G2 at the position in the vicinity of the right side end of guide bushing 12, a switching passage is opened.

In the condition where the movable mother die 7 and the stationary mother die 3 are clamped and the mating surfaces thereof are contacted with each other, the right side end of the guide bushing 12 and the left side end of the spool bushing 10 are mated so that the powder control valve guide hole G2 is integrally coupled with the powder control valve guide hole G1 to coaxially for a single powder control valve guide hole G.

Within the powder control valve guide hole G defined in the spool bushing 10 and the guide bushing 12, a powder control valve V is movably arranged.

The powder control valve V includes a cylindrical valve portion 14 tightly contact with the powder control valve guide hole G at the right side end thereof and a smaller diameter cylindrical portion 15 extending toward left from the cylindrical valve portion 14. Also, from the smaller diameter cylindrical portion 15, a guide cylindrical portion 16 is extended toward left. Also, an operation rod portion 17 is extended from the guide cylinder portion 16 toward left.

The reference numeral 18 denotes a driving device constituted of a pneumatic cylinder, a hydraulic cylinder, a spring or so forth and arranged in opposition to the powder control valve V, for controlling the position of the powder control valve V in the left and right direction in the drawing.

An output rod of the driving device 18 is coupled with the operation rod portion 17 of the powder control valve V.

The switching passage 13 is communicated with the powder discharge passage 20 which is, in turn, communicated with the powder storage tank T via a switching valve 19. The switching passage 13 is also communicated with a vacuum suction passage 21 which is, in turn, communicated with a vacuum source P via the switching valve 19.

The switching valve 19 blocks communication between the switching passage 13 and the vacuum suction passage 21 when the switching passage 13 and the powder discharge passage 20 are communicated with each other. Conversely, when communication between the switching passage 13 and the powder discharge passage 20 is blocked, communication between the switching passage 13 and the vacuum suction passage 21 is established.

The reference numeral 22 denotes a powder suction passage which opens to the mold cavity C at one end and is communicated with a vacuum pump or so forth as a not shown pressure reducing device Q at the other end. The powder suction passage is controlled to be open and closed by a switching valve 24 operated by a driving device 23.

At the position where the powder control valve V is located at the rightmost shift position in the powder control valve guide hole G, the cylindrical valve portion 14 of the powder control valve V blocks communication between the sleeve 8 and the opening 10A which is, in turn, communicated with the molten material supply passage 11 and establishes communication between the opening 10A and the switching passage 13.

On the other hand, at the position the powder control valve V is located at the leftmost shift position, the cylindrical valve portion 14 establishes communication between the sleeve 8 and the opening 10A and blocks communication between the opening 10A and the switching passage 13.

Next, the operation will be discussed hereinafter.

One cycle of casting process in a die-casting is generally separated into a mold lubricant applying step, a vacuum introducing step, a molten material supplying step, an injection step, a solidifying step and a product removing step (for convenience, the mold lubricant applying step is assumed as the first step).

The mold lubricant applying step is a step for applying a mold lubricant on mold surface 1A and 4A of the molding cavity C. The vacuum introducing step is to reduce the pressure within the mold cavity C and maintain the mold cavity in vacuum condition. The molten material supplying step is a step pouring a molten material through a molten material supply hole 8*a* within the sleeve 8. The injection step is step for injecting the molten material supplied to the sleeve 8 into the mold cavity C via a molten material supply passage 11 by shifting the plunger tip 9. The solidifying step is a step for solidifying the molten material injected into the mold cavity C. The product removing step is a step removing the product solidified in the mold cavity C.

Here, respective process steps will be discussed in detail.

At first, discussion will be given for the mold lubricant application step.

The movable mother die 7 and the stationary mother die 3 are mated and clamped, and then the stationary insert die 1 and the movable insert die 4 are mated for defining the mold cavity C. At this time, the plunger tip 9 located at the right end of the sleeve 8 to open the molten material hole 8A.

Figure 2:
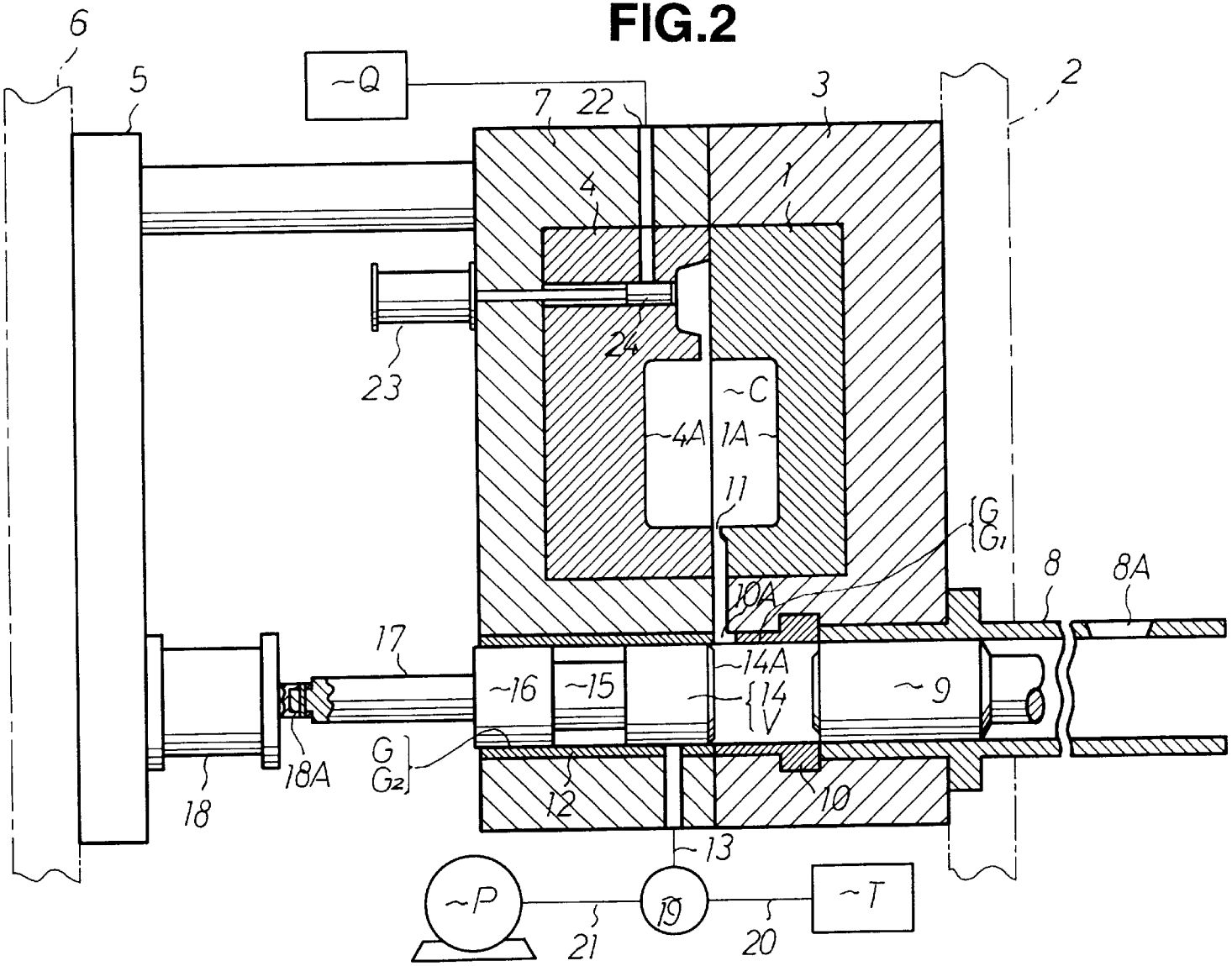
FIG. 2 is a section similar to FIG. 1 but showing a condition where the communication between the sleeve and the opening is established by the powder control valve.

Then, by driving the driving device 18, an output rod 18A is expanded toward right to move the operation rod portion 17 toward right to forward the powder control valve V toward right in FIG. 1. At this condition as shown in FIG. 1, the right side end 14A of the cylindrical valve portion 14 is located mating with the sleeve 8, and the cylindrical valve portion 14 is arranged in tight fitting on the powder control valve guide hole G1 opposing the sleeve 8. The cylindrical valve portion 14 blocks communication between the sleeve 8 and the opening 10A communicating with the molten material supply passage 11.

On the other hand, the outer periphery of the smaller diameter cylindrical portion 15 located at the left side of the cylindrical valve portion 14 and the powder control valve guide hole G define an annular gap. The switching passage 13 and the opening 10A communicated with the molten material supply passage 11 are communicated through the gap.

On the other hand, the switching passage 13 and the powder discharge passage 20 communicated with the powder storage tank T are communicated via a switching valve 19. At this time, the switching passage 13 and the vacuum introducing passage 21 are blocked from communication.

Also, by driving the driving device, the switching valve 24 is moved toward left as shown to open the powder suction passage G2 and to reduce pressure within the mold cavity C.

Then, at this condition, by driving the pressure reducing device Q to reduce the pressure acts on the powder discharge passage 20 via the molten material supply passage 11, the opening 10A, the gap defined on the outer periphery of the smaller diameter cylindrical portion, the switching passage 13 and the switching valve 19.

Then, the powder state mold lubricant within the molding cavity abut onto the mold surfaces 1A and 4A to be applied on the mold surface.

On the other hand, the powder state mold lubricant residing in the mold cavity C is sucked toward the pressure reducing device Q via the powder suction passage 19 and then discharged.

A period for reducing the pressure within the molding cavity C by the pressure reducing device Q, in other words, a period for applying the powder state mold lubricant on respective mold surfaces 1A and 4A by supplying the powder state mold lubricant into the molding cavity C may be set at an optimal period depending upon surface structure of the molding cavity C and capacity of the molding cavity C. After expiration of the given period, the switching valve 24 is driven by the driving device 23 to close the powder suction passage 22. When the powder suction passage 22 is closed, vacuum condition in the molding cavity C is released. Therefore, supply of the powder state mold lubricant into the molding cavity from the powder discharge passage 20 is automatically stopped.

Discussion will be given with respect to vacuum introducing step.

The powder suction passage 22 is maintained in closed position by the switching valve 24.

The powder control valve V is in the rightwardly shifted position similarly to the application step of the powder state mold lubricant.

On the other hand, the switching passage 13 and the vacuum suction passage 21 are communicated by the switching valve 19, and the switching passage 13 and the powder discharge passage 20 are blocked by the switching valve 19.

Then, the vacuum pressure generated in the vacuum source P reaches the opening 10A through respective passages set forth above and is introduced into the mold cavity C via the molten material supply passage 11. Accordingly, the inside of the mold cavity C is held in vacuum condition.

The vacuum condition in the mold cavity is maintained until the powder control valve V is shifted toward left to block communication between the opening 10A and the vacuum suction passage 21 by the cylindrical valve portion 14.

Next, molten material supply step will be discussed. In the molten material supplying or teeming step, the powder control valve V, the plunger tip 9, the switching valve 24 and switching valve 19 are held in the same conditions as those in the vacuum pressure introducing step.

Namely, at the position shifted toward right of the powder control valve V, the cylindrical valve portion 14 is tightly fitted to the powder control valve guide G1 of the spool bushing 10 to block communication between the sleeve 8 and the opening 10A.

On the other hand, concerning the plunger tip 9, the plunger tip 9 is located at the right side end of the sleeve 8 to opens the molten material supply opening 8A.

Then, a desired amount of the molten material is supplied from the molten material supply hole 8A to the sleeve 8.

The foregoing is the molten material supply step of the molten material into the sleeve 8, such molten material supply step and the mold lubricant applying step can be performed simultaneously. This is because that the powder control valve V is in the rightwardly shifted position, the cylindrical valve portion 14 blocks communication between the sleeve 8 and the opening 10A.

Next, injection step will be discussed.

The plunger tip 9 located in the vicinity of the right side end of the sleeve is shifted toward left in the drawing for gradually reducing the volume in the sleeve 8 according to shifting of the plunger tip 9.

When the shifting speed of the plunger tip 9 becomes high speed shifting from the initial low speed shifting, the pressure of the molten material in the sleeve 8 is elevated. The pressure of the molten material is bore by the right side end of the powder control valve V. Thus, the powder control valve V is shifted toward left against the biasing force of the driving device 18 toward right.

When the powder control valve V is shifted toward left, the cylindrical valve portion 14 blocks communication between the opening 10A and the switching passage 13 and establishes communication between the opening 10A and the sleeve 8.

By this, the molten material in the sleeve 8 is pressurized and injected into the mold cavity C in the vacuum condition via the opening 10A and the molten material supply passage 11. This condition is illustrated in FIG. 2.

Initiation timing of leftward shifting of the powder control valve V is preferred to be at least after transition into the high speed shifting of the plunger tip 9.

After completion of injection step, the mold is held in clamped condition for a predetermined period. During this period, the molten material injected into the mold cavity C is cooled and solidified. This is the solidifying step.

Next step is the product removing step. In advance of removal of the cast block, the movable mother die 7 is released away from the stationary mother die 3 to be in the unclamped position. Thus, the product solidified in the mold cavity C and thus cast is moved together with the movable mother die in the adhering position on the mold surface 4A of the cavity C of the movable insert die 4. Thereafter, by means of a not shown pushing pin, the cast product is pushed out of the mold surface 4A of the movable insert die. Thus, the product can be removed from the die.

It should be noted that molten material and the product are illustrated in blank form.

As set forth above, by the application method of the powder mold lubricant according to the present invention, the following particular effects.

(1) Introduction of vacuum into the mold cavity is performed after the mold lubricant application step by shutting off the powder suction passage 22 by the switching valve 24 and establishing communication between the vacuum introduction passage 21 and the switching passage 13 with operation of the switching valve 19.

With the foregoing procedure, operation for introducing vacuum becomes quite simple and easy. Furthermore, the mold cavity can be effectively maintained in vacuum condition to permit vacuum casting in good condition.

The powder mold lubricant is supplied into the mold cavity C through the powder discharge passage 20, switching valve 19, the switching passage 13, a gap between the powder control valve guide hole G and the smaller diameter cylindrical portion 15, the opening and the molten material supply passage 11.

With the construction set forth above, the powder mold lubricant passes through passages having small volume, the flow velocity of the powder mold lubricant can be increased so that the powder mold lubricant may not fall down to be accumulated therein. Accordingly substantially all of the powder mold lubricant supplied from the powder discharge passage 20 can be supplied to the mold cavity. This makes it unnecessary to supply large amount of powder mold lubricant in consideration of falling down and accumulation in the passage and thus can achieve significant economical effect.

(2) Since the powder mold lubricant may not falls down in respective passages, the accumulated powder mold lubricant may not be admixed the molten material upon injection of the molten material. Thus, quality of cast product can be improved.

(3) In the powder mold lubricant application step, it becomes unnecessary to operate the plunger chip for shifting forward, stopping and shifting backward for application of the powder mold lubricant.

By this, cycle time of vacuum casting from the powder mold lubricant application step to the product removing step can be shortened to contribute for improvement of production efficiency.

(4) In the mold lubricant application step and the vacuum pressure introducing step, the powder control valve V is shifted at the rightmost position, communication between the sleeve 8 and the opening 10A is blocked by the cylindrical valve portion 14.

Therefore during operation in the powder mold lubricant application step and the vacuum pressure introducing step, the molten material supplying step can be performed simultaneously.

Accordingly, the cycle time of the casting operation can be significantly shortened to improve production ability and to lower the casting cost.

(5) On the outer periphery of the powder control valve guide hole G communicated with the sleeve 8, the opening 10A and the switching passage 13 connected to the molten material supply passage 11 are formed. Within the powder control valve guide hole G, the powder control valve V establishing and blocking communication between the opening 10A, the sleeve 8 and the switching passage 13 is movable disposed so that the switching passage 13 is selectively communicated with the powder discharge passage 20 and the vacuum introducing passage 21 by the switching valve 19. Also, the switching valve 24 is disposed in the powder suction passage 22 communicated with the mold cavity C.

Thus, the construction becomes quite simple. Therefore, application of the shown embodiment of the powder mold lubricant application method to the conventional vacuum casting apparatus becomes easy.

(6) Amongst, coaxially arranging the longitudinal axis of the sleeve 8 and the longitudinal axis of the powder control valve guide hole G, and arranging the powder control valve V along the longitudinal axis, and providing the cylindrical valve portion 14 in the powder control valve V, which establishes and blocks communication between the opening 10A and the sleeve 8, and also establishes and blocks communication between the switching passage 13 and the opening 10A, are suitable for down-sizing of the overall apparatus including the powder control valve V.

Figure 3:
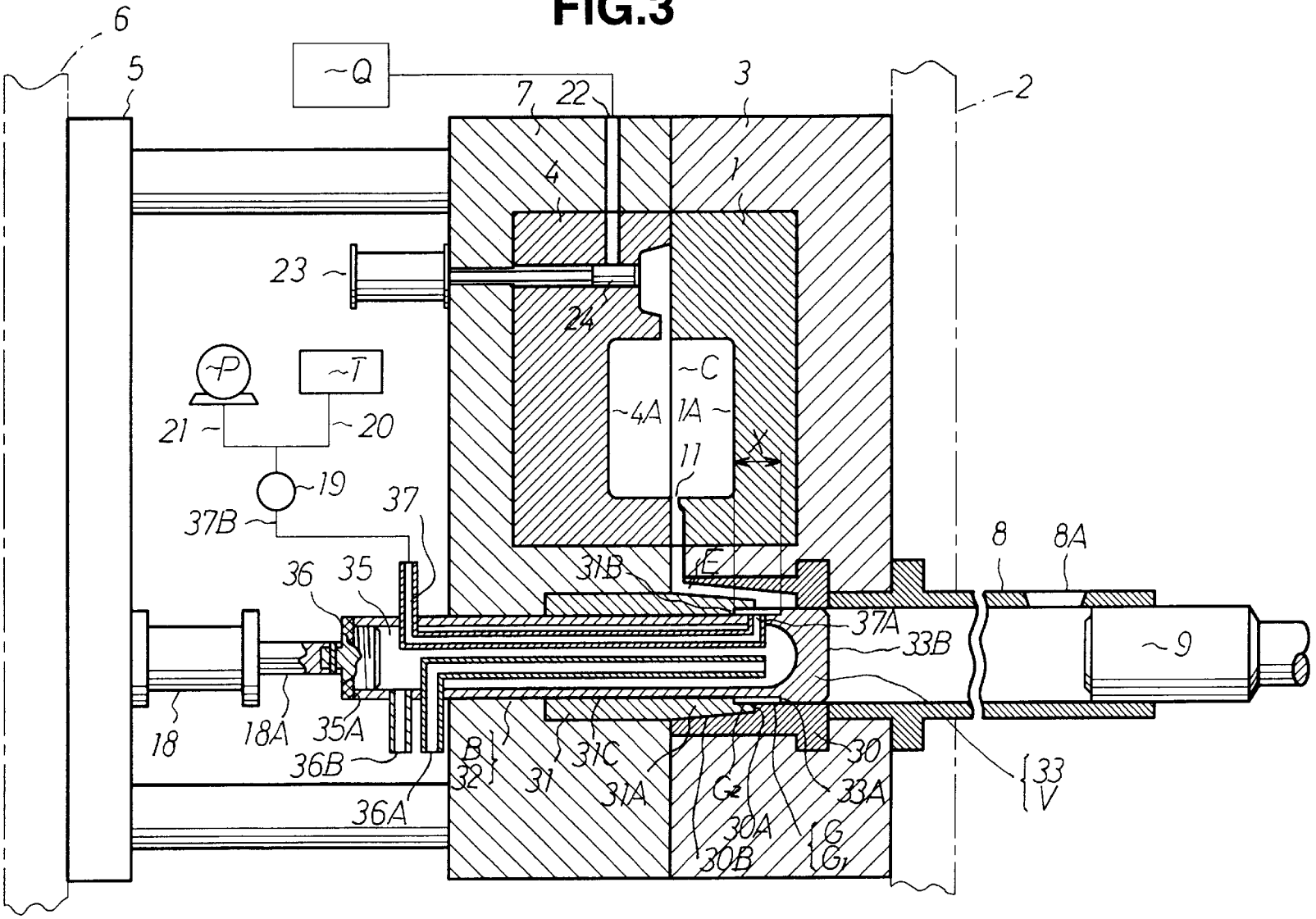
FIG. 3 is a section showing the major part of the second embodiment of the die-casting apparatus according to the present invention.

FIG. 3 shows another embodiment of the vacuum die-casting apparatus according to the present invention. In the following disclosure, like components to those in the foregoing first embodiment will be identified by like reference numerals and the detailed description for such common components will be neglected for keeping the application simple enough to facilitate clear understanding of the present invention.

The reference numeral 30 denotes a spool bushing fixedly arranged in the stationary mother die. The right side end of the spool bushing 30 is in contact with the left side end of the sleeve 8. In the spool bushing 30, the powder control valve guide hole G1 is formed to extend toward left from the right side end. A guide bushing receptacle hole 30B, to which the guide bushing is to be engaged, is communicated with the powder control guide hole G1 via an engaging step portion 30A, and is extended toward the left side end of the spool bushing 30.

The powder control valve guide hole G1 opens to the inside of the sleeve 8. The guide bushing receptacle hole 30B opens to the left side end of the spool bushing 30.

Within the powder control valve guide hole G1, an opening 30C is opened. The opening 30C is communicated with the mold cavity C via the molten material supply passage 11.

On the movable mother die 7, a guide bushing 31 is fixedly arranged to extend toward right from the right side end of the movable mother die 7.

A guide projection 31A of the guide bushing 31 projecting from the right side end surface of the movable mother die 7 has a shape to engage with the guide bushing receptacle hole 30B of the spool bushing 30.

On the other hand, from the right side end of the guide projection 31A of the guide bushing 31 toward left, the powder control valve guide hole G2 having the equal diameter to that of the powder control valve guide hole G1 of the spool bushing 30, is formed. A smaller diameter guide hole 31C communicated with the powder control valve guide hole G1 via an engaging step portion 31B is extended toward the left side end of the guide bushing 31.

A guide hole 32 is formed to extend from the left side end of the movable mother die 7 to the guide hole 31C of the guide bushing 31. The guide hole 32 and the guide hole 31 are provided the same diameter and aligned to each other in coaxial relationship.

With the construction set forth above, in the vicinity of the left side of the stationary mother die 3, the spool bushing 30 is arranged. Also, the at the left side end of the stationary mother die 3, the guide bushing receptacle hole 30B of the spool bushing 30 is opened. Furthermore, the engaging step 30A and the powder control valve guide hole G1 are opened mating with the left side end of the stationary mother die 3.

In the vicinity of the left side end of the stationary mother die 3, the sleeve 8 having the plunger tip 9 is fixedly arranged. The left end of the sleeve 8 is in contact with the right side end of the spool bushing 30. Also, with mating the sleeve 8, the powder control valve guide hole G1 of the spool bushing is opened.

In the vicinity of the right side end of the movable mother die, the guide bushing 31 is fixedly arranged. From the right side end of the movable mother die 7, the guide projecting portion 31A is projected toward right.

From the right side end of the guide projecting portion 31A, the powder control valve guide hole G2 is extended toward left. From the engaging step portion 31B formed at the left side of the powder control valve guide hole G2, the guide hole 31C is extended toward the left side end of the guide bushing 31.

Communicating with the guide hole 31C of the guide bushing, the guide hole 32 formed opening at the left side end of the movable mother die 7 is formed.

When the stationary mother die 3 and the movable mother die 7 are clamped with mating the left side end of the stationary mother die 3 and the right side end of the movable mother die 7. The guide projecting portion 31A of the guide bushing 31 engages within the guide bushing engaging hole 30B of the spool bushing 30, the right side end of the guide projecting portion 31A abuts against the engaging step portion 30A of the spool bushing 30.

On the other hand, the powder control valve guide hole G1 of the spool bushing 30 and the powder control valve guide hole G2 of the guide bushing 31 are integrally coupled to form the powder control valve guide hole G. Also, the guide hole 31C of the guide bushing 31 and the guide hole 32 of the movable mother die 7 are arranged coaxially.

Namely, the powder control valve guide hole G1 and the powder control valve guide hole G2 are so coupled to form a single powder control valve guide hole G. The guide hole 31 and the guide hole 32 are so coupled to form a single guide hole B.

The sleeve 8 is formed coaxially with the powder control valve guide hole G1 of the spool bushing 30, and is communicated with the interior space of the sleeve. On other hand, the left side end of the movable mother die 7 opens to the guide hole 32.

The opening 30C opening in the powder control valve guide hole G1 is communicated with the molten material supply passage 11 via the passage E formed by the internal peripheral portion of the guide bushing engaging hole 30B and the external peripheral portion of the guide projection 31A. The molten material supply passage 11 opens to the mold cavity C.

Within the powder control valve guide hole G formed in the spool bushing 30 and the guide bushing 31 and the guide hole B formed within the guide bushing 31 and the movable mother die 7, the powder control valve V is movably disposed.

The powder control valve V is formed at the right side end of the cylindrical valve portion 33. From the cylindrical valve portion 33, the sliding cylinder portion 34 is formed to extend toward left.

The cylindrical valve portion 33 moves within the powder control valve guide hole G in tightly contact with the powder control valve guide hole G. From the stepping-down portion 33A at the left side of the cylindrical valve portion 33, the sliding cylinder portion 34 having smaller diameter that that of the cylindrical valve portion 33 and extending toward left, is movable disposed slidably within the guide hole B.

The right side end 33B of the cylindrical valve portion 33 is arranged in opposition to the sleeve 8. The powder control valve V shifts in a stroke corresponding to a distance where the stepping down portion 33A of the cylindrical valve portion 33 abut against the engaging step portion 31B of the guide bushing 31.

The reference numeral 35 denotes a cooling cavity recessed toward a portion in the vicinity of the right side end 33B of the cylindrical valve portion 33 from the left side end 35A (left side end of the sliding cylindrical portion 34) of the powder control valve V. The opening to the left side end 35A of the cooling cavity 35 is closed by a closure plug 36.

Accordingly, the cooling cavity 35 forms an enclosed chamber.

In the cooling cavity 35, the cooling water introducing passage 36A and the cooling water discharge passage 36B open. The cooling liquid is supplied into the cooling cavity 35 from the cooling water introducing passage 36A. The cooling liquid circulates in the cooling cavity 35, and thereafter discharged from the cooling water discharge passage 36B. Thus, the inside of the cooling cavity 35 is maintained at a constant temperature.

The reference numeral 37 denotes a switching passage arranged within the cooling cavity 35. The discharge opening 37A opens to the outer periphery of the sliding cylindrical portion 34 in the vicinity of the cylindrical valve portion 33, An inflow opening 37B is communicated with the switching valve 19.

In the condition where the output rod 18A of the driving device is extracted toward right, the powder control valve is located at the right most position in the drawing. The cylindrical valve portion 33 blocks communication between the sleeve 8 and the opening 30C and establishes communication between the discharge opening 37A of the switching passage 37 and the opening 30C.

On the other hand, in the condition where the output rod 18A is retracted toward left, the powder control valve V is located at the leftwardly shifted position in the drawing. Then, the stepping down portion 33A of the cylindrical valve portion 33 abuts onto the engaging step portion 31B of the powder control valve guide hole G2.

Figure 4:
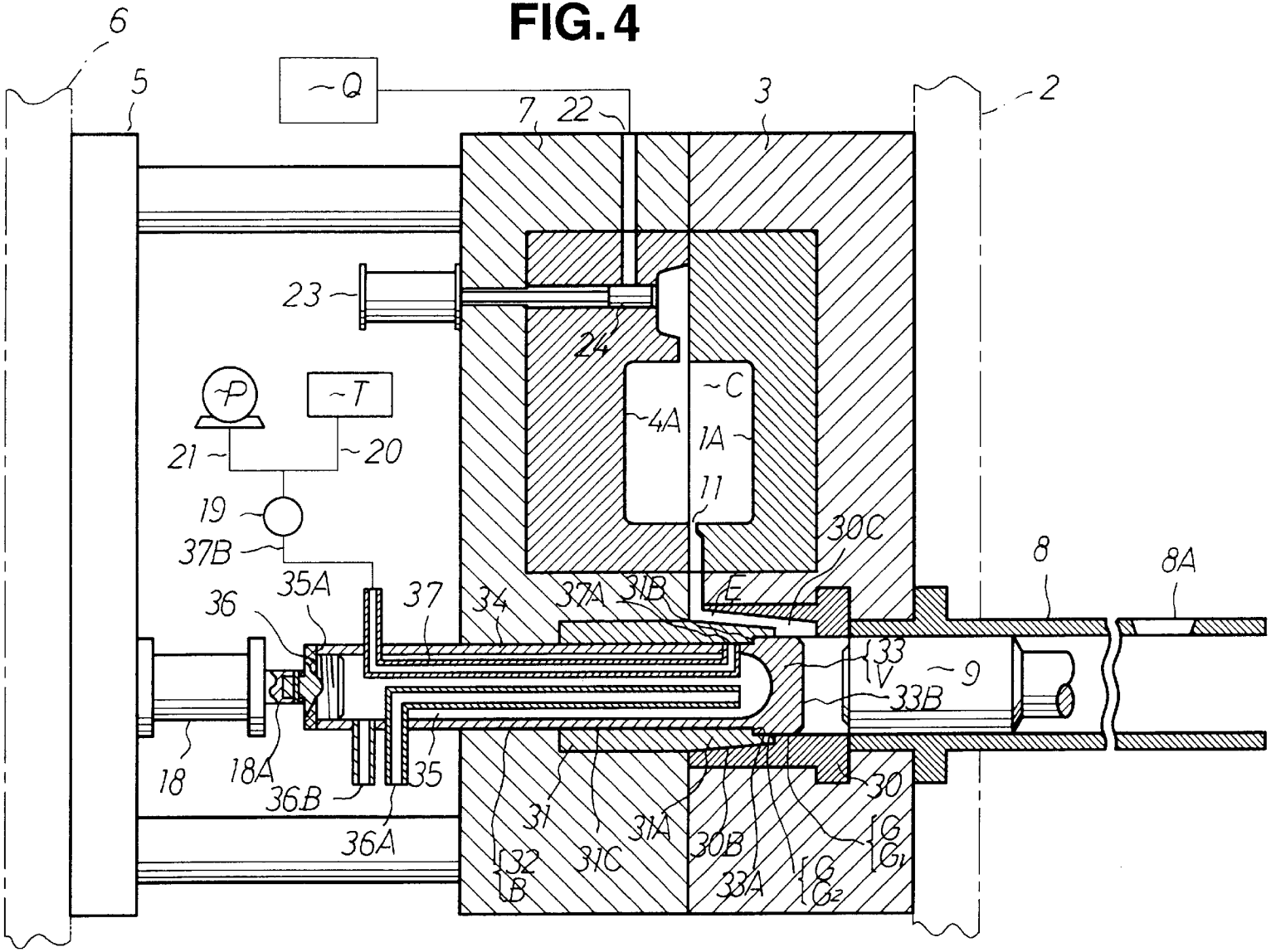
FIG. 4 is a section similar to FIG. 3 but showing a condition where the communication between the sleeve and the opening is established by the powder control valve.

This condition is illustrated in FIG. 4.

At this condition, the sleeve 8 and the opening 30C are communicated, and the discharge opening 37A of the switching passage 37 is closed by the outer periphery of the guide hole 31C and the cylindrical valve portion 33. Thus communication between the discharge opening 37A and the 30C are blocked.

Next, operation of the second embodiment of the vacuum die-casting apparatus according to the present invention will be discussed hereinafter.

The vacuum die-casting is performed similarly to those of the first embodiment.

At first, discussion will be given for the mold lubricant application step.

The movable mother die 7 and the stationary mother die 3 are mated and clamped, and then the stationary insert die 1 and the movable insert die 4 are mated for defining the mold cavity C. At this time, the plunger tip 9 abuts with the right end of the sleeve 8 to open the molten material hole 8A. Then, by driving the driving device 18, an output rod 18A is expanded to forward the powder control valve V toward right in FIG. 1.

At this condition, the right side end 33B of the cylindrical valve portion 33 is located mating with the sleeve 8, and the cylindrical valve portion 33 is arranged in tight fitting on the powder control valve guide hole G1 opposing the sleeve 8. The cylindrical valve portion 33 blocks opening 30C communicating the sleeve 8 and the molten material supply passage 11. On the other hand, the discharge opening 37A of the switching passage 37 opens to the powder control valve guide valve G from the outer periphery of the sliding cylindrical portion 34 and communicates with the opening 30C opening in the powder control valve guide hole G. The opening 30C is communicated with the mold cavity C via the passage E and the molten material supply passage 11. By operating the switching valve 19, the powder discharge passage 20 and the switching passage 37 are communicated. Furthermore, by driving the driving device 23, the switching valve 24 is shifted toward left in the drawing to open the powder suction passage 22. By the powder suction passage 22, the mold cavity C and the pressure reducing device Q are communicated.

A cooling liquid is introduced into the cooling cavity 35 by the cooling water introducing passage 36A. The cooling liquid is circulated within the cooling cavity 35 and thereafter again discharged from the cooling water discharge passage 36B. The liquid temperature in the cooling cavity 35 is maintained at a temperature lower than or equal to a melting or liquefying temperature of an organic type powder contained in the powder mold lubricant, e.g. lower than or equal to 120° C.

Supply of the cooling liquid into the cooling cavity 35 has to be performed at least in the application step of the mold lubricant.

In such condition, by driving the pressure reducing device Q, the vacuum is introduced into the molding cavity C for situating the mold cavity in vacuum condition.

The lowered pressure in the molding cavity C acts to the discharge opening 37A of the powder discharge passage 37, the inflow opening 37B, the switching valve 19 and the powder discharge passage 20 via the molten material supply passage 11, the passage E, the opening 30C and the powder control valve guide G.

As set forth above, in the powder storage source T, the powder mold lubricant, such as wax, talc, graphite and the like, in super fine solid in floating condition to flow by air is sucked into the opening 30C through the switching passage 37, the discharge opening 37A and the powder control valve guide hole G, and further sucked into the mold cavity C from the opening 30C via the passage E and the molten material passage 11. Thus, the molding cavity C is filled with the powder mold lubricant.

Then, the powder mold lubricant within the molding cavity collides on the mold surfaces 1A and 4A to be applied on the mold surface.

On the other hand, the powder mold lubricant residing in the mold cavity C is sucked toward the pressure reducing device Q via the powder suction passages 22 and 19.

In the application step of the powder mold lubricant, the powder mold lubricant passing through the switching passage 37 is cooled at a temperature condition lower than or equal to a predetermined temperature by the cooling liquid within the cooling cavity.

Namely, when a fine particle mixture sold of wax, talc, graphite or the like is employed as the powder mold lubricant, among these components, the organic type powder may liquefy at about 120° C. Therefore, by cooling the switching passage 37 by the cooling liquid in the cooling cavity 35 so that the temperature of the powder mold lubricant passing through the switching passage 37 becomes lower than or equal to 120° C. Thus, liquefying of the powder mold lubricant can be successfully prevented.

As set forth above, the powder mold lubricant will never be liquefied in the switching passage 37. Thus, the powder mold lubricant in floating condition can be supplied into the molding cavity C from the discharge opening 37A of the switching passage 37 through the opening 30C, the passage E and the molten material passage 11.

Accordingly, the powder mold lubricant supplied from the powder storage source T may not be retained within the intermediate supply piping and all can be supplied into the molding cavity C, and thus achieves economical effect.

On the other hand, avoiding liquefying of the powder mold lubricant permits supply of the powder mold lubricant in fine particle condition into the molding cavity. Thus, the powder mold lubricant can be applied uniformly over the entire surface of the mold surfaces 1A and 4A of the molding cavity C without no portion remained in non-applied.

Vacuum introducing step will be performed in the following manner.

With respect to the condition in the application step of the powder mold lubricant, the powder suction passage 22 is closed by the switching valve 24. On the other hand, by operating the switching valve 19, the vacuum pressure introducing passage 21 and the switching passage 37 are communicated. In such condition, the vacuum pressure generated in the vacuum source P is introduced into the mold cavity C via the vacuum pressure introducing passage 21, the switching valve 19, the switching passage 27, the discharge opening 37A, the powder control valve guide hole G, the opening 30C, the passage E and the molten material supply passage 11. Thus, the inside of the mold cavity C can be maintained in vacuum condition.

Discussing the molten material supply step, the molten material supply step can be performed simultaneously with the mold lubricant application step or the vacuum pressure introducing step. The plunger tip 9 is located at the right side end of the sleeve to opens the a molten material supply opening 8A. The molten material is supplied into the sleeve 8 from the molten material supply opening 8A.

The injection step is performed in the similar manner to that of the first embodiment. The switching valve 24 maintains the powder suction passage 22 in closed position. After high speed movement of the plunger tip 9, the cylindrical valve portion 33 of the powder control valve V is shifted toward left in a distance X. The stepped down portion 33A contacts with the engaging step 31B of the guide bushing 31 to stop leftward motion.

Accordingly, the molten material pressurized in the sleeve 8 is injected into the mold cavity C in vacuum condition via the opening 30C, the passage E and the molten material supply passage 11.

On the other hand, the discharge opening 37A of the switching passage 37 is closed by the guide hole 31C of the guide bushing 31 and the outer periphery of the cylindrical valve portion 33.

This condition is shown in FIG. 4.

(1) The powder mold lubricant flowing through the switching passage 37 is cooled to be lower than or equal to the predetermined temperature by a cooling liquid in the cooling cavity 35 and sucked from the discharge opening 37A.

As set forth above, the organic type powder as a component of the powder mold lubricant can be maintained at a temperature condition lower than or equal to the liquefying temperature, the powder mold lubricant may not be liquefied within the passage from the discharge opening 37A to the mold cavity C.

Since the powder mold lubricant may not be liquefied, the liquefied powder mold lubricant may not be admixed the molten material upon injection of the molten material. Thus, quality of cast product can be improved.

(2) Suppression of liquefying of the powder mold lubricant, upon unclamping after molding, the oil smoke due to liquefied powder mold lubricant will never be generated to significantly improve working environment.

Furthermore, it becomes unnecessary to install large scale scavenger facility.

(3) In order to maintain the powder mold lubricant lower than or equal to the predetermined temperature, the cooling cavity 35 storing the cooling liquid within the powder control valve G can be formed. The powder discharge passage 17 is arranged within the cooling cavity. Thus, the powder mold lubricant can be effectively maintained in the temperature condition lower than or equal to the predetermined temperature. Furthermore, the device for cooling the powder mold lubricant can be construction in quite simple structure and thus can be formed compact. Also, implementation on the conventional mother die becomes easy.

According to the method for applying a powder mold lubricant onto a die-casting mold, according to the present invention, the powder mold lubricant will not pass through the chamber or passage having large volume but pass through passages having small volume, the powder mold lubricant will never fall down to be accumulated within the passage. Therefore substantially overall powder mold lubricant can be supplied from the powder discharge passage. Therefore, wasting of the powder mold lubricant is little to improve economical effect.

Furthermore, since the powder mold lubricant will never be admixed with the molten material upon injection of the latter in the sleeve into the mold cavity. Thus, the quality of the cast product becomes high and stable.

By cooling the powder discharge passage to a temperature lower than the liquefying temperature of the powder mold lubricant, the organic powder as component of the powder mold lubricant can be maintained at the temperature condition lower than or equal to the liquefying temperature. Therefore, the powder mold lubricant will never be liquefied in the passage to reach the mold cavity. Accordingly, the powder mold lubricant may not be admixed with the molten material. Thus the cast with high quality and high stability.

Furthermore, upon unclamping of the mold after forming, oil smoke which is otherwise generated by the liquefied powder mold lubricant, and thus work environment can be improved significantly.

In the powder mold liquid application step, it becomes unnecessary to operate the plunger tip to move forward, stop and move backward for applying the powder mold lubricant, it becomes possible to perform molten material supply step simultaneously with the powder mold lubricant applying step or the vacuum pressure introducing step. Thus cycle time in casting can be shortened for improving production efficiency and achieving lowering of casting cost.

By arranging the powder control valve within the powder control valve guide hole movably, and establishing and blocking communication between the opening and switching passage communicated with the sleeve and the molten material supply passage by the powder control valve, the apparatus can be formed compact and the structure can be formed simple. Therefore, application for the conventional mother die can be easy to employ.

By providing the cooling cavity in the powder control valve, by arranging the switching passage within the cooling cavity. The apparatus for cooling the powder mold lubricant can be constructed in simple structure. Thus, the apparatus becomes compact. Furthermore, it becomes possible to apply for the conventional mother die.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

We claim:

1. A method for applying a powder mold lubricant in a vacuum die-casting apparatus comprising:

clamping a movable mother die and a stationary mother die, and defining a mold cavity by a movable insert die and a stationary insert die, in which a plunger chip is movably disposed within a sleeve opens a molten material supply hole and blocks communication between said sleeve and said mold cavity;

an application step of applying a powder mold lubricant to a mold surface of said mold cavity by directly supplying a powder mold lubricant in a powder storage tank directly to a mold cavity through a powder discharge passage and a molten material supply passage;

a vacuum pressure introducing step blocking a powder suction passage opening to said mold cavity and communicating a vacuum source and a molten material supply passage opening in said mold cavity, for maintaining the interior of said mold cavity in vacuum condition, the vacuum pressure introducing step being performed following said powder mold lubricant application step.

2. A method for applying a powder mold lubricant in a vacuum die-casting apparatus as set forth in claim 1, at any one of said powder mold lubricant application step in the clamping condition or said vacuum pressure introducing step, a molten material may be supplied into said sleeve from said molten material supply hole.

3. A method for applying a powder mold lubricant in a vacuum die-casting apparatus as set forth in claim 1, wherein said powder discharge passage is cooled at a temperature lower than or equal to a liquefying temperature of said powder mold lubricant.

4. A vacuum die-casting apparatus comprising:

a powder control valve guide hole opening to a sleeve, in which a plunger chip is movably disposed, and opening and switching passage communicated with a molten material supply passage being formed on the outer periphery thereof;

a powder control valve disposed within said powder control valve guide hole and being operated by a driving device in such a manner that, in a condition where communication between said opening and said sleeve is blocked, communication between said opening and said switching passage is established, and in a condition where communication between said opening and said sleeve is established, communication between said opening and said switching passage is blocked;

a powder suction passage communicated with a pressure reducing device at one end and opening to said mold cavity at the other end for controlling to open and close by a switching valve; and a switching valve for selectively communicating one of a vacuum pressure introducing passage connected to a vacuum pressure source and a powder discharge passage connected to a powder storage tank, to a switching passage.

5. A vacuum die-casting apparatus comprising:

a powder control valve guide hole opening to a sleeve, in which a plunger chip is movably disposed, and opening and switching passage communicated with a molten material supply passage being formed on the outer periphery thereof;

a powder control valve disposed within said powder control valve guide hole, defining a chamber therein, an opening of said switching passage arranged in said chamber being opened on the outer periphery of a sliding cylindrical portion, and being operated by a driving device in such a manner that, in a condition where communication between said opening and said sleeve is blocked, communication between said opening and said switching passage is established, and in a condition where communication between said opening and said sleeve is established, communication between said opening and said switching passage is blocked;

a powder suction passage communicated with a pressure reducing device at one end and opening to said mold cavity at the other end for controlling to open and close by a switching valve; and a switching valve for selectively communicating one of a vacuum pressure introducing passage connected to a vacuum pressure source and a powder discharge passage connected to a powder storage tank, to a switching passage.

6. A vacuum die-casting apparatus as set forth in claim 5, wherein said chamber recessed in said powder control valve is enclosed, a cooling liquid being circulated within said chamber through a cooling water introducing passage and a cooling water discharging passage for cooling said switching passage at a temperature lower than or equal to a liquefying temperature of said powder mold lubricant.

7. A vacuum die-casting apparatus as set forth in claim 5, wherein a powder control valve guide hole is formed mating with said sleeve in coaxial fashion, said powder control valve movably disposed in said powder control valve guide hole is arranged in opposition to a plunger chip movably disposed within said sleeve.

* * * * *